US005456519A

United States Patent [19]

Davis

[11] Patent Number: 5,456,519

[45] Date of Patent: Oct. 10, 1995

[54] BACK CUSHION AND SEAT CUSHION SYSTEM

[76] Inventor: Samuel C. Davis, 3917 Rock Ridge Rd., Birmingham, Ala. 35210

[21] Appl. No.: 269,107

[22] Filed: Jun. 30, 1994

[51] Int. Cl.[6] ..... A47C 7/00

[52] U.S. Cl. ..... 297/440.15; 297/230.13; 297/219.10; 297/DIG. 6; 297/452.32

[58] Field of Search ..... 297/219.1, 219.12, 297/440.15, DIG. 6, 452.26, 452.27, 452.32, 452.3, 230.13, 284.4; 5/652.35

[56] References Cited

U.S. PATENT DOCUMENTS

| | | | |
|---|---|---|---|
| 2,807,313 | 9/1957 | Kaufman | 297/230.13 |
| 3,220,767 | 11/1965 | Hendrickson | 297/DIG. 6 |
| 4,824,169 | 4/1989 | Jarrell | 297/DIG. 6 |
| 4,912,788 | 4/1990 | Lonardo | 297/230.13 |
| 5,149,173 | 9/1992 | Jay et al. | 297/DIG. 6 |
| 5,310,245 | 5/1994 | Lyszczasz | 297/219.12 |

*Primary Examiner*—Peter R. Brown
*Assistant Examiner*—Anthony Barfield

[57] ABSTRACT

A seat cushion and back cushion system comprising a back cushion further comprising a lower section having an inner surface, an outer surface, a bottom edge with opposed side edges, and a raised sacral counter pressure pad disposed thereon; and a upper section extended upwards from the lower section, the upper section having an inner surface, an outer surface, a top edge with opposed side edges coupled with the side edges of the lower section, with the inner surface and the side edges thereof bulging outwards to define a curved pillow; a seat cushion further comprising a raised outer section for supporting the femurs of a user thereon having a inner surface, an outer surface, and a front edge and opposed and side edges extended laterally therefrom; and a depressed inner section having an inner surface, an outer surface, a top edge and opposed side edges extended from the top edge and coupled to the side edges of the outer section, and two spaced concave depressions formed thereon defining a saddle.

5 Claims, 3 Drawing Sheets

BACK CUSHION AND SEAT CUSHION SYSTEM

BACKGROUND OF THE INVENTION

1. Field of the Invention

The present invention relates to a back cushion and seat cushion system and more particularly pertains to supporting specific areas of a user's back and posterior to eliminate fatigue and pain in the sacroiliac and lumbar area with a back cushion and seat cushion system.

2. Description of the Prior Art

The use of cushions is known in the prior art. More specifically, cushions heretofore devised and utilized for the purpose of supporting a user's back and posterior are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,062,589 to Klein et al. discloses a chair with contoured seat. U.S. Pat. No. 4,930,171 to Frantz discloses a contour retaining support cushion. U.S. Pat. No. 4,960,304 to Frantz discloses a contour retaining back support cushion. U.S. Pat. No. 5,052,068 to Graebe discloses a contoured seat cushion. U.S. Pat. No. 5,163,737 to Navach et al. discloses a cushion.

While these devices fulfill their respective, particular objective and requirements, the aforementioned patents do not describe a back cushion and seat cushion system that uses two adjustably securable and contoured cushions in supporting specific areas of a user's back and posterior for eliminating back fatigue and pain in the sacroiliac and lumbar area.

In this respect, the back cushion and seat cushion system according to the present invention substantially departs from the conventional concepts and designs of the prior art, and in doing so provides an apparatus primarily developed for the purpose of supporting specific areas of a user's back and posterior to eliminate fatigue and pain in the sacroiliac and lumbar area.

Therefore, it can be appreciated that there exists a continuing need for new and improved back cushion and seat cushion system which can be used for supporting specific areas of a user's back and posterior to eliminate fatigue and pain in the sacroiliac and lumbar area. In this regard, the present invention substantially fulfills this need.

SUMMARY OF THE INVENTION

In the view of the foregoing disadvantages inherent in the known types of cushions now present in the prior art, the present invention provides an improved back cushion and seat cushion system. As such, the general purpose of the present invention, which will be described subsequently in greater detail, is to provide a new and improved back cushion and seat cushion system and method which has all the advantages of the prior art and none of the disadvantages.

To attain this, the present invention essentially comprises, in combination, a back cushion. The back cushion includes a generally rectangular lower section having an inner surface, an outer surface, a periphery defined by a bottom edge with opposed side edges extended upwards therefrom, a generally trapezoidal and raised sacral counter pressure pad centrally disposed thereon to support a user's sacrum with the sacral counter pressure pad having a periphery defined by an extended upper edge, and retracted lower edge, and opposed side edges extending upwards and outwards from the lower edge to the upper edge, and a lower strip of pile-type fastener coupled to its outer surface near the bottom edge. The back cushion includes an upper section extended upwards from the lower section with the upper section having an inner surface, an outer surface, a periphery defined by a top edge with opposed side edges extended downwards therefrom and coupled with the side edges of the lower section in curvature with the inner surface and the side edges thereof bulging outwards near the top edge to define a curved pillow adapted for supporting a user's lumbar curve, and an upper strip of pile-type fastener coupled to the outer surface and adapted to be secured to a complimentary pile-type fastener on a back of a chair. A back cover is included and secured about the back cushion for protecting the back cushion from wear and damage.

A seat cushion is provided. The seat cushion includes a generally rectangular and raised outer section for supporting the femurs of a user thereon with the outer section having an inner surface, an outer surface, a periphery defined by a front edge and opposed side edges extended laterally therefrom, and a lower strip of pile-type fastener coupled to the outer surface and adapted to be secured to a complimentary pile-type fastener on a seat of a chair. The seat cushion includes a generally rectangular and depressed inner section having an generally L-shaped inner surface, a generally L-shaped outer surface, a periphery defined by a top edge and opposed side edges extended from the top edge and coupled with the side edges of the outer section, two spaced concave depressions centrally formed thereon defining a saddle adapted for holding a user's ischial tuberosities therein, and an upper strip of complementary pile-type fastener coupled to the inner surface near the top edge adjustably securable with the lower strip of pile-type fastener of the lower section of the back cushion. A seat cover is included and secured over the seat cushion for protecting the seat cushion from wear and damage.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved back cushion and seat cushion system which has all the advantages of the prior art cushions and none of the disadvantages.

It is another object of the present invention to provide a new and improved back cushion and seat cushion system which may be easily and efficiently manufactured and marketed.

It is a further object of the present invention to provide a new and improved back cushion and seat cushion system which is of durable and reliable construction.

An even further object of the present invention is to provide a new and improved back cushion and seat cushion system which is susceptible of a low cost of manufacture with regard to both materials and labor, and which accordingly is then susceptible of low prices of sale to the consuming public, thereby making such a back cushion and seat cushion system economically available to the buying public.

Still yet another object of the present invention is to provide a new and improved back cushion and seat cushion system which provides in the apparatuses and methods of the prior art some of the advantages thereof, while simultaneously overcoming some of the disadvantages normally associated therewith.

Even still another object of the present invention is to provide a new and improved back cushion and seat cushion system for supporting specific areas of a user's back and posterior to eliminate fatigue and pain in the sacroiliac and lumbar area.

Lastly, it is an object of the present invention to provide a new and improved back cushion and seat cushion system comprising a back cushion further comprising a lower section having an inner surface, an outer surface, a periphery defined by a bottom edge with opposed side edges extended upwards therefrom, and a raised sacral counter pressure pad disposed thereon for supporting a user's sacrum; and an upper section extended upwards from the lower section, the upper section having an inner surface, an outer surface, a periphery defined by a top edge with opposed side edges extended downwards therefrom and coupled with the side edges of the lower section, with the inner surface and the side edges thereof bulging outwards to define a curved pillow adapted for supporting a user's lumbar curve; a seat cushion further comprising a raised outer section for supporting the femurs of a user thereon having a inner surface, an outer surface, and a periphery defined by a front edge and opposed and side edges extended laterally therefrom; and a depressed inner section having an inner surface, an outer surface, a periphery defined by a top edge and opposed side edges extended from the top edge and coupled to the side edges of the outer section, and two spaced concave depressions formed thereon defining a saddle adapted for holding a user's ischial tuberosities therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
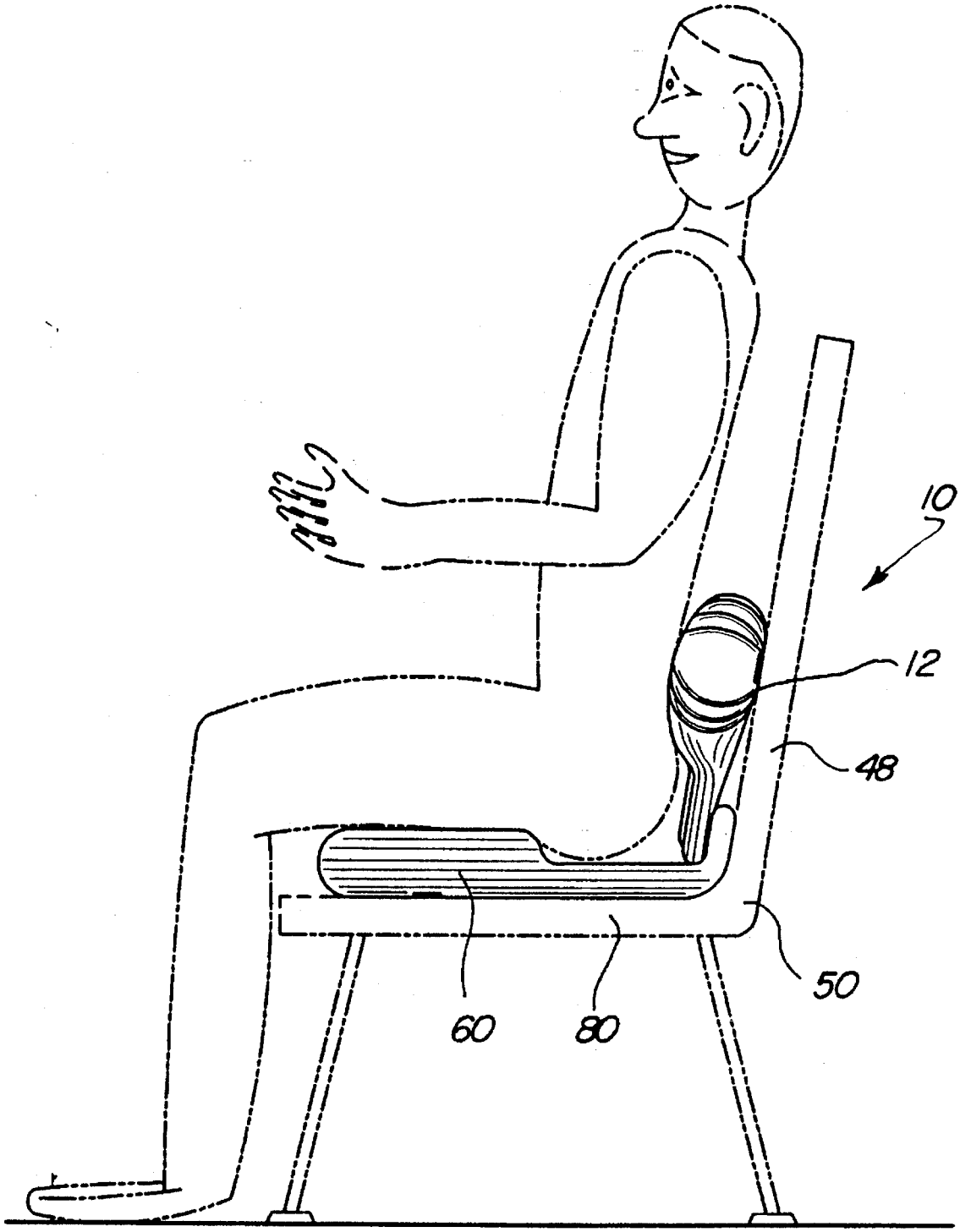
FIG. 1 is a perspective view of the preferred embodiment of the back cushion and seat cushion system constructed in accordance with the principles of the present invention.
Figure 2:
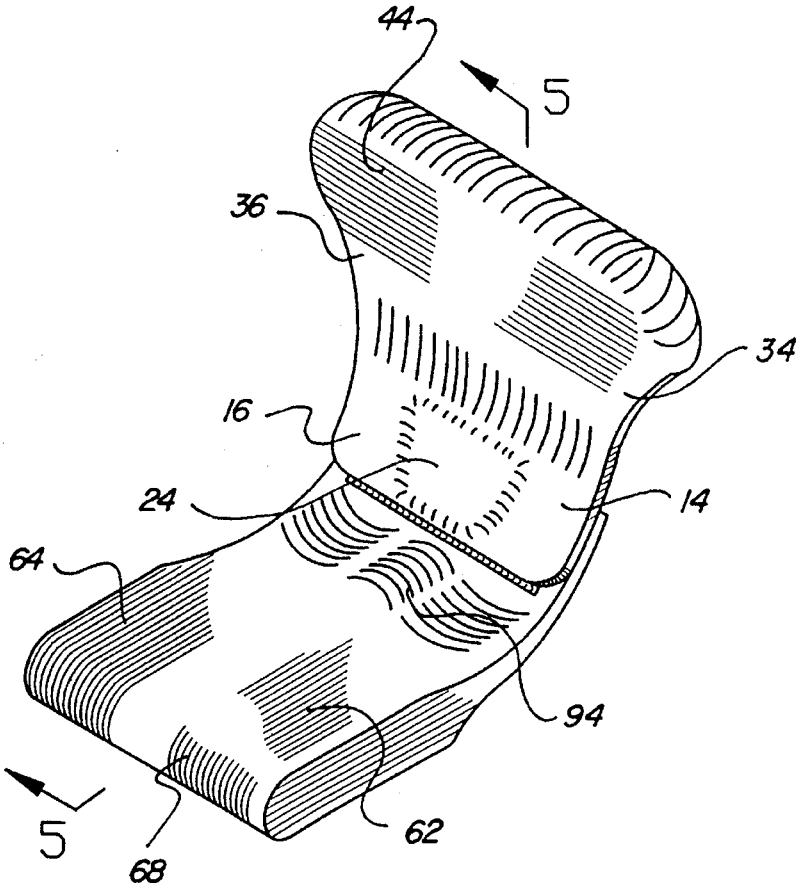
FIG.2 is a perspective view of the present invention with the lower cushion positioned horizontally and the upper cushion extended upwards.
Figure 3:
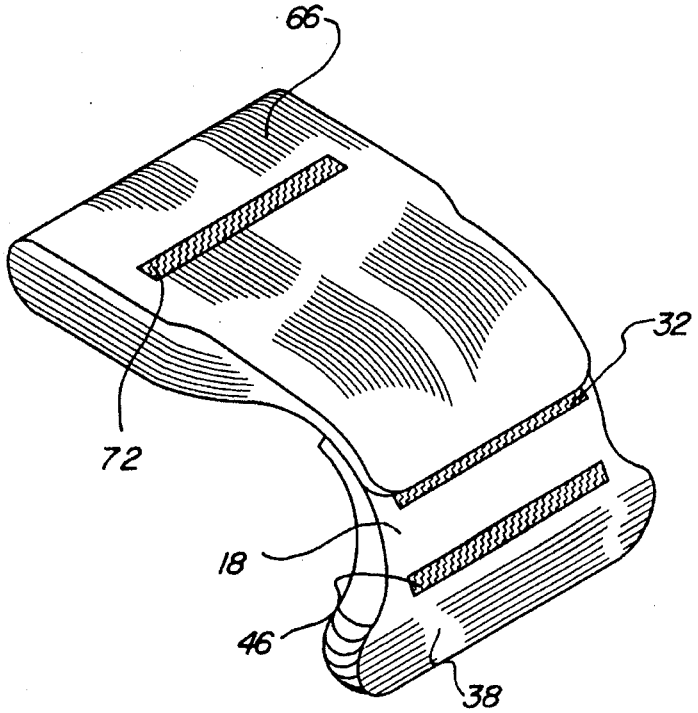
FIG. 3 is a perspective view of the present invention with the lower cushion positioned horizontally and the upper cushion extended downwards.
Figure 4:
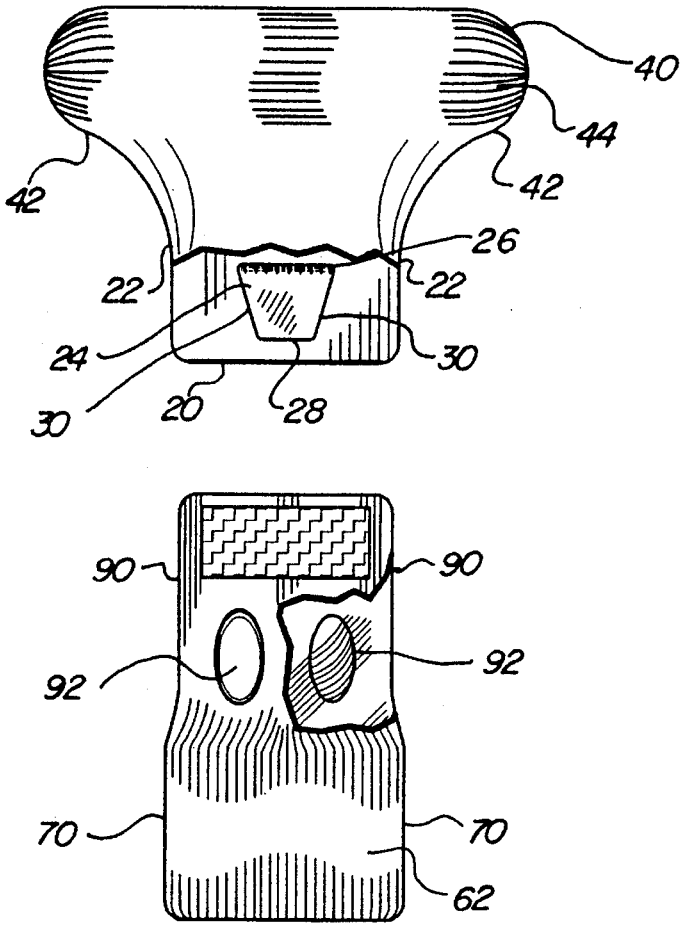
FIG. 4 is an exploded plan view of the present inventions with portions of the upper cushion and lower cushion removed for depicting the sacral counter pressure pad and one of the depressions.
Figure 5:
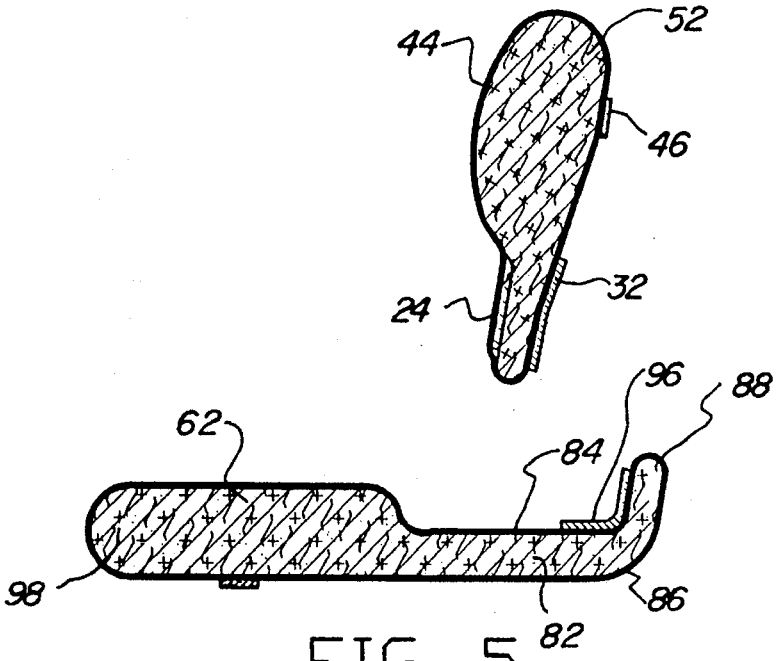
FIG. 5 is an exploded side-elevational view of the present invention.

With reference now to the drawings, and in particular, to FIG. 1 thereof, the preferred embodiment of the new and improved back cushion and seat cushion system embodying the principles and concepts of the present invention and generally designated by the reference number 10 will be described.

Specifically, the present invention includes four major components. The major components are the back cushion, the back cover, the seat cushion, and the seat cover. These components are interrelated to provide the intended function.

More specifically, it will be noted in the various Figures that the first major component is the back cushion 12. The back cushion includes a generally rectangular lower section 14. The lower section has a inner surface 16 and an outer surface 18. The lower section also has a periphery defined by a bottom edge 20 with opposed side edges 22 extended upwards therefrom. The lower section includes a generally trapezoidal and raised sacral counter pressure pad 24 centrally disposed thereon. The sacral counter pressure pad is used to support a user's sacrum. The sacral counter pressure pad has a periphery defined by an extended upper edge 26, a retracted lower edge 28 and opposed side edges 30 extended upwards and outwards from the lower edge to the upper edge. The lower section also includes a lower strip 32 of pile-type fastener coupled to its exterior surface 18 near the bottom edge 20.

The back cushion includes an upper section 34. The upper section is extended upwards from the lower section. The upper section has an inner surface 36 and an outer surface 38. The inner surface 36 and outer surface 38 are integrally coupled with the inner surface 16 and outer surface 18 of the lower section 14. The upper section has a periphery defined by a top edge 40 with opposed side edges 42 extended downwards therefrom and coupled with the side edges 22 of the lower section 14 in curvature. The inner surface and the side edges of the upper section bulge outwards near the top edge to define a curved pillow 44. The curved pillow is adapted for supporting a user's lumbar curve. The upper section also includes an upper strip of pile-type fastener 46 coupled to the outer surface 38. This upper strip of pile-type fastener is adapted to be secured to a complimentary pile-type fastener on a back 48 of a chair 50 for holding the back cushion in a fixed position thereagainst.

The second major component is the back cover 52. The back cover is formed of plastic. It is secured about the back cushion 12. It is used for protecting the back cushion from wear and damage. The back cover can be formed such that it is removable for replacement or cleaning. The back cover may also be made of cloth.

The third major component is the seat cushion 60. The seat cushion includes an outer section 62. The outer section is generally rectangular and raised in structure. The outer section is used for supporting the femurs of a user sitting thereon. The outer section has an inner surface 64 and an outer surface 66. The outer section also has a periphery defined by a front edge 68 and opposed side edges 70 extended laterally therefrom. A lower strip 72 of pile-type fastener is coupled to the outer surface 66 of the outer section. This lower strip of pile-type fastener is adapted to be secured to a complimentary pile-type fastener on a seat 80 of a chair for holding the seat cushion in a fixed position thereagainst.

The seat cushion also includes an inner section 82. The inner section is generally rectangular and depressed in structure. The inner section has a generally L-shaped inner surface 84 and a generally L-shaped outer surface 86. The inner surface 84 and outer surface 86 are integrally coupled with the inner surface 64 and outer surface 66 of the outer section 62. The inner section has a periphery defined by a top edge 88 with opposed side edges 90 extended from the top edge and coupled with the side edges 70 of the outer section 62. The inner section includes two spaced concave depressions 92 centrally formed thereon. These two concave depressions define a saddle 94 on the inner surface 84. The saddle is adapted for holding a user's contour formed by the ischial tuberosities therein. The inner section also includes an upper strip 96 of complimentary pile-type fastener coupled to the inner surface near the top edge 88. This upper strip of complimentary pile-type fastener is adjustably securable with the lower strip 32 of pile-type fastener of the lower section 14 of the back cushion 12. Thus, based upon a user's height, the back cushion may be adjustably secured either upwards or downwards to achieve a proper fit against a user's back.

The fourth major component is the seat cover 98. The seat cover is formed of a flexible plastic. It is secured over the seat cushion. The seat cover is adapted for protecting the seat cushion from wear and damage. The seat cover can be formed such that it is removable for replacement or cleaning. The seat cover may also be made of cloth.

People who suffer from lower back pain know that it often helps to sit with something that supports their "lumbar curve." However, a patient's pain is often due to more than just problems with the lumbar curve. In particular, the sacroiliac joints are recognized as playing a major role in quite a few cases of lumbo-pelvic pain. Whether from wear, trauma or hormonal change, the articulation between the hip bones and the sacrum may be stressed resulting in discomfort for the patient. Prior art devices such "Lumbar Roll" cushions can alleviate some of this pain, and there are specifically designed "posture" chairs which partially reduce the stress on the ischial seats of a user. However, none of these device treat all of the problem areas simultaneously.

The present invention is specially designed to provide support for specific areas to simultaneously eliminate pain in the sacroiliac joints and lumbar area. With its unique support of the femurs, lumbar curve and contouring for the ischium, the present invention removes stress on the ischial seats of a user and provides self-bracing for the innominates. The present invention is formed of two cushions so that they can be adjusted to fit differing lengths of the lower back. The cushions of the present invention may consist of two pieces of molded plastic or polyurethane foam of the appropriate density. The two sections are connected together in a telescopic fashion with hook and loop fasteners.

The back cushion is approximately 17" long and has an upper section and a lower section which are connected together by a "necked-in" area of the cushion. The upper section forms a small pillow and lower section is a curved profile extended downward from the pillow. Both sections support the lumbar curve. The pillow is about 13" wide, about 4" long and about 2.5" thick at the widest point at its center. From this pillow the thickness slopes down to approximately ¾ of an inch at the lower section.

The lower section of the back cushion is to be placed in contact with a user's sacrum, and in this section the contour of the cushion thickens to create the sacral counter pressure pad. The exact location of this pad will be determined by anatomical average measurements. This area is an inverted trapezoidal shape approximately 3½" wide at the upper edge and tapers to approximately 1½" at the lower edge. This pad is about ½" thicker (or less) than the surrounding cushion.

The seat cushion of the present invention has an outer section and an inner section. The outer section is positioned under, and supports, the femurs is rectangular in shape and is about 15" wide, about 9" long and about 2¼" thick. The outer section is raised above the inner section by approximately ¾ of an inch or larger, so that pressure points are not created in the legs of a patient when the seat cushion is in contact therewith.

Progressing inward from the outer section to the inner section, the thickness of the seat cushion decreases to about ¾ of an inch. It is at the inner section where the seat cushion contacts an area adjacent to patient's ischial seats. Furthermore, it is in this inner section that the seat cushion has a special profile to relieve pressure on this area. In the center portion of the inner section there are two shallow, oblong, and spaced depressions formed on the cushion for accommodating a user's ischial tuberosities. These trenches are approximately 1¾" long and there is a ridge of cushion therebetween which gives the effect of a saddle. The side edges of the inner section of the back cushion adjacent to this saddle are cupped inward to form a lip which provides a cradling effect.

Progressing inward across the inner section, the inner section bends and takes on a vertical attitude. The sides narrow slightly, and the thickness of the inner section is reduced to about ¾". This portion of the inner section is adjustably securable with the hook and loop fasteners with the lower section of the back cushion.

To use the present invention, the seat cushion thereof is placed on a chair so its outer section provides vertical support for a user's femurs, thus transferring the load to the femoral heads. The user's ischial tuberosities fit comfortably in the saddle of its inner section. The back cushion adjustably coupled with the seat cushion so that the sacral counter pressure pad of its lower section is correctly positioned and the pillow of its upper section maintains the physiological curve of the lumbar in the anterior direction. The present invention should be a great help for physical therapists, clinicians and the consumer as well.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A back cushion and seat cushion system for supporting specific areas of a user's posterior and back to eliminate fatigue and pain in the sacroiliac and lumbar area comprising, in combination:

a back cushion further comprising:

a generally rectangular lower section having an inboard inner surface, an outboard outer surface, a periphery interconnecting the surfaces formed of a bottom edge with opposed side edges extended upwards therefrom, an inverted raised trapezoidal sacral counter pressure pad centrally disposed on the inner surface and projected outwards therefrom at a location near the bottom edge for supporting a user's sacrum and with the sacral counter pressure pad having a periphery defined by an extended upper edge, a retracted lower edge, and opposed angular side edges extending from the lower edge to the upper edge, the lower section further having a lower strip of pile-type fastener coupled to its outer surface at a location near the bottom edge thereof; and an upper section extended upwards from the lower section, the upper section having an inboard inner surface, an outboard outer surface, a periphery interconnecting the surfaces formed of a top edge with opposed side edges extended downwards therefrom and coupled with the side edges of the lower section in curvature and with the inner surface and the side edges thereof bulging outwards at a location near the top edge to define an elongated curved pillow sized for supporting a user's lumbar curve, the upper section further having an upper strip of pile-type fastener coupled to its outer surface for securement to a complimentary pile-type fastener on a back of a chair;

a back cover secured about the back cushion for protecting the back cushion from wear and damage;

a seat cushion further comprising:

a generally rectangular and raised outer section for supporting the femurs of a user thereon, the outer section having an upper inner surface, a lower outer surface, and a periphery interconnecting the surfaces formed of a front edge and opposed side edges extended laterally therefrom, the outer section further having a lower strip of pile-type fastener coupled to its outer surface for securement to a complimentary pile-type fastener on a seat of a chair;

a generally rectangular and depressed inner section having an generally L-shaped cross-section and an upper inner surface, a lower outer surface, a periphery interconnecting the surfaces formed of a top edge and opposed side edges extended from the top edge and coupled with the side edges of the outer section, and two spaced concave symmetric depressions centrally formed thereon with each depression having a generally oval cross section and with the depressions in combination with the spacing therebetween defining a saddle for holding a user's ischial tuberosities therein, the inner section further having an upper strip of complementary pile-type fastener coupled to its inner surface at a location near the top edge thereof and with the upper strip adjustably securable with the lower strip of pile-type fastener of the lower section of the back cushion; and a seat cover secured over the seat cushion for protecting the seat cushion from wear and damage.

2. A seat cushion and back cushion system comprising:

a back cushion further comprising:

a lower section having an upper inner surface, lower outer surface, a periphery interconnecting the surfaces formed of a bottom edge with opposed side edges extended upwards therefrom, and a raised inverted trapezoidal sacral counter pressure pad disposed thereon for supporting a user's sacrum; and an upper section extended upwards from the lower section, the upper section having an inboard inner surface, an outboard outer surface, a periphery interconnecting the surfaces formed of a top edge with opposed side edges extended downwards therefrom and coupled with the side edges of the lower section, with the inner surface and the side edges thereof bulging outwards to define an elongated curved pillow adapted for supporting a user's lumbar curve; the upper section having a lateral width and thickness that is greater than a respective lateral width and thickness of the lower section;

a seat cushion further comprising:

a raised outer section for supporting the femurs of a user thereon having an upper inner surface, a lower outer surface, and a periphery interconnecting the surfaces formed of a front edge and opposed and side edges extended laterally therefrom; and a depressed inner section having an an upper inner surface, an a lower outer surface, a periphery defined by a top edge and opposed side edges extended from the top edge and coupled to the side edges of the outer section, and two spaced concave depressions formed thereon and with the depressions in combination with the spacing therebetween defining a saddle for holding a user's ischial tuberosities therein.

3. The seat cushion and back cushion system as set forth in claim 2 further including cushion coupling means for adjustably securing the upper cushion with the lower cushion.

4. The seat cushion and back cushion system as set forth in claim 2 further including chair coupling means for coupling the upper cushion and the lower cushion to a chair.

5. The seat cushion and back cushion system as set forth in claim 2 wherein the back cushion and seat cushion are formed of polyurethane foam.

* * * * *